US005540142A

United States Patent [19]

Mieleszuk et al.

[11] Patent Number: 5,540,142

[45] Date of Patent: Jul. 30, 1996

[54] MACHINE FOR STRAPPING SHEET METAL COIL

[75] Inventors: Jan Mieleszuk, Chicago; Stanislaw Witczak, Norwood Park Township, both of Ill.

[73] Assignee: Signode Corporation, Glenview, Ill.

[21] Appl. No.: 168,126

[22] Filed: Dec. 17, 1993

[51] Int. Cl.[6] ..... B65B 27/06

[52] U.S. Cl. ..... 100/4; 100/12

[58] Field of Search ..... 100/4, 25, 26, 100/12, 30, 33 R, 916

[56] References Cited

U.S. PATENT DOCUMENTS

| | | | |
|---|---|---|---|
| 3,118,367 | 1/1964 | Lindholm | 100/4 |
| 3,291,037 | 12/1966 | Kunka et al. | 100/4 |
| 3,362,321 | 1/1968 | Lindholm et al. | 100/4 |
| 3,566,779 | 3/1971 | Kronsbein | 100/4 |
| 3,583,310 | 6/1971 | Blough | 100/4 |
| 3,924,526 | 12/1975 | Bühne | 100/25 |
| 4,829,753 | 5/1989 | Bricmont | 100/12 |

*Primary Examiner*—Stephen F. Gerrity
*Attorney, Agent, or Firm*—Schwartz & Weinrieb

[57] ABSTRACT

In a machine for strapping a sheet metal coil, two rollers support such a coil with its axis extending transversely. A carriage mounted upon a fixed base is longitudinally movable toward and away from the rollers. A strapping head cradle mounted upon the carriage is movable with the carriage and is pivotable about a transverse axis. Two strap-guiding arms mounted upon the cradle, extend forwardly, and are movable with the cradle, pivotable with the cradle, and pivotable on the cradle between a closed position defining a closed path for a strap and an opened position enabling the strap-guiding arms to clear the supported coil when the cradle is moved with the carriage. A coil-sensing arm extending over the strap-guiding arms is mounted upon the carriage, movable with the carriage, and pivotable about a transverse axis. Fluid-powered mechanisms coact with the cradle and with the coil-sensing arm, by means of a pivotal connection defining a transverse axis, for pivoting the cradle less rapidly and the coil-sensing arm simultaneously but more rapidly.

13 Claims, 9 Drawing Sheets

FIG. 6A
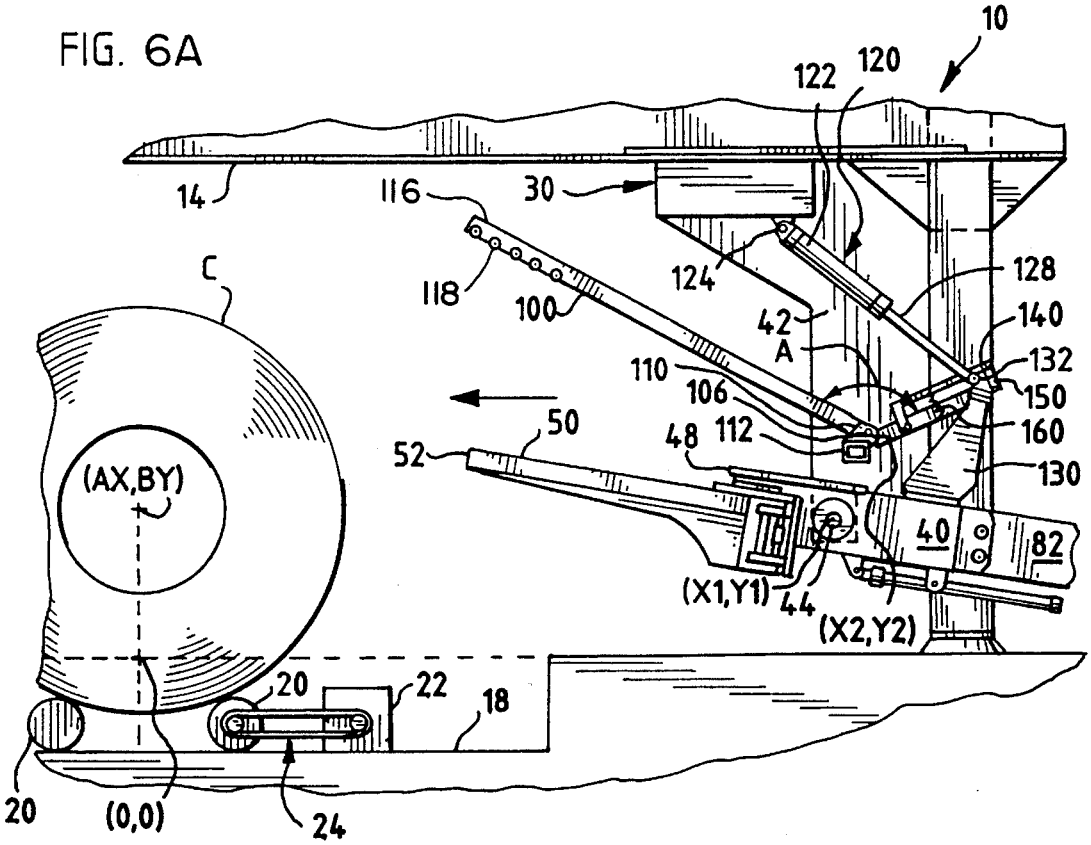
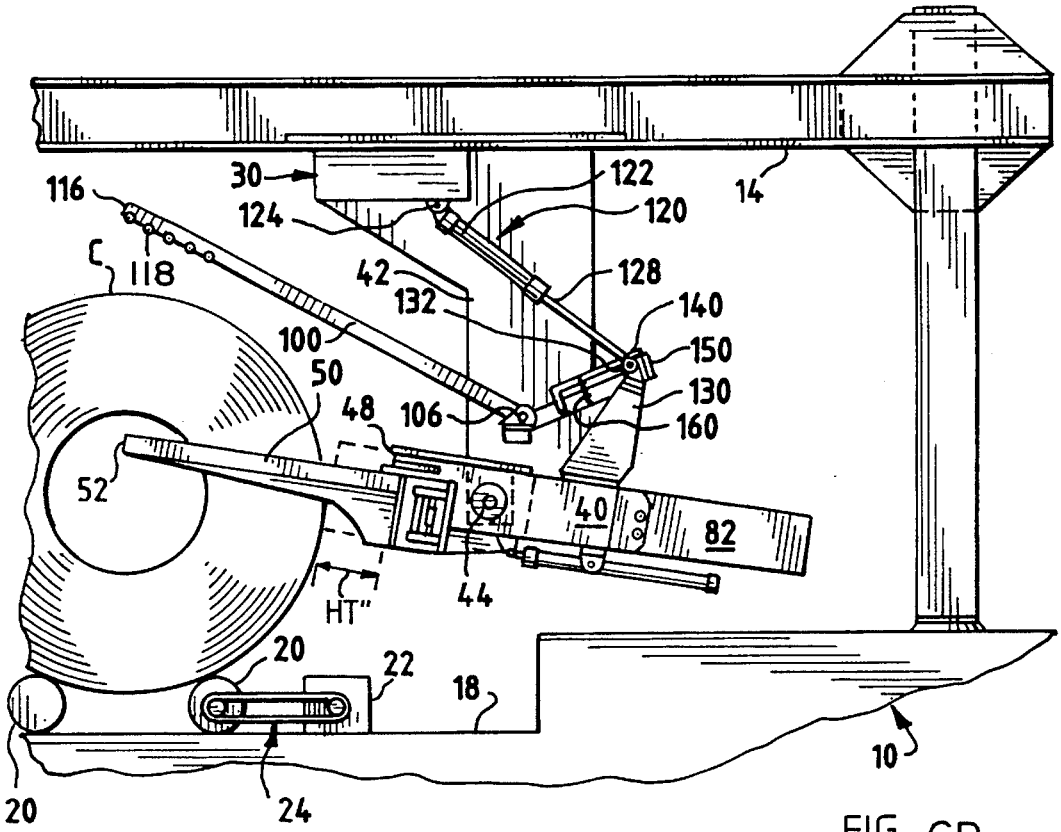
FIG. 6B

FIG. 6C
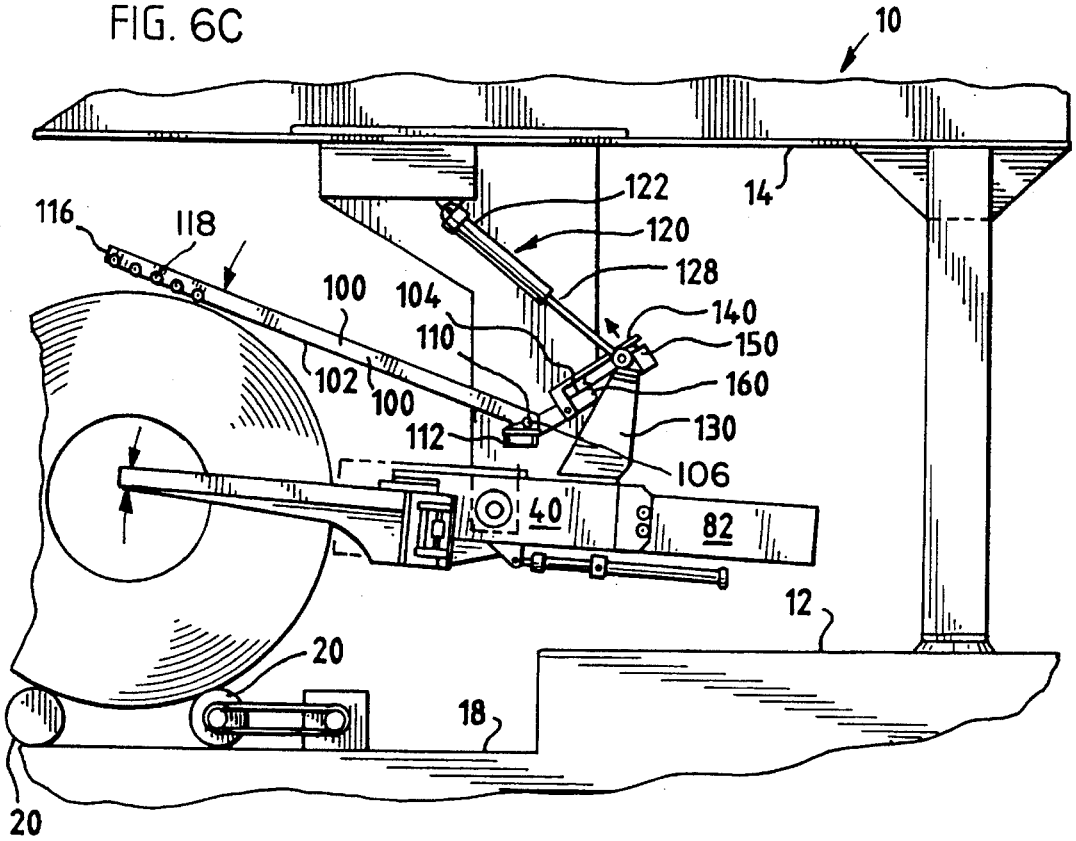
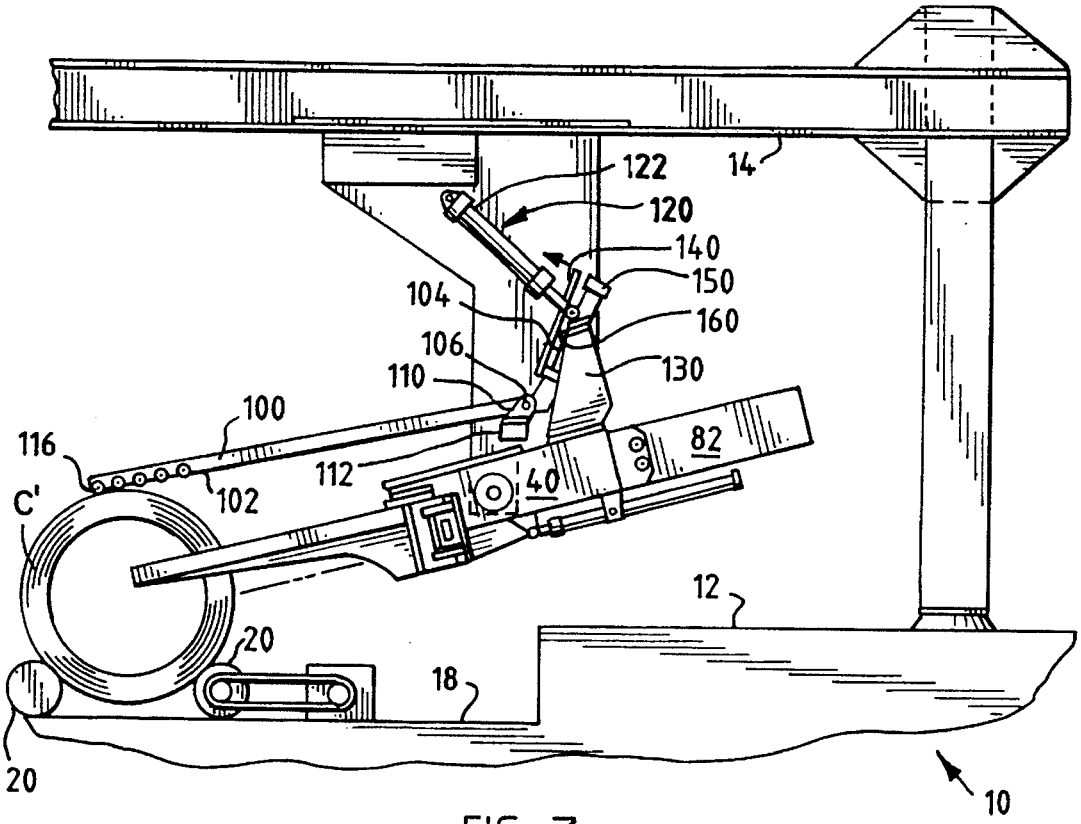
FIG. 7

10
70
STRAP DISPENSER
14
14
38
30
80
56
34
34
56
50
50
32
32
100
40
40

MACHINE FOR STRAPPING SHEET METAL COIL

TECHNICAL FIELD OF THE INVENTION

This invention pertains to a machine for strapping a sheet metal coil, such as a sheet steel coil, which has an eye defining a coil axis. Two strap-guiding arms are pivotable on a cradle. A coil-sensing arm is pivotable on a carriage. When a pivoting means pivots the coil-sensing arm on the carriage to a position wherein the coil-sensing arm engages a supported coil, the pivoting means also pivots the cradle and the strap-guiding arms on the cradle to positions wherein a part of a strap-guiding path defined by the strap-guiding arms when pivoted on the cradle to a closed position passes generally along the coil axis.

BACKGROUND OF THE INVENTION

It has been known to strap a sheet metal coil, such as a sheet steel coil, by feeding a steel or plastic strap through the eye of the coil, tensioning the strap to form a tensioned loop around multiple layers of the steel coil, severing the tensioned loop from any remaining strap, and sealing the tensioned loop by applying a steel seal. For strapping such a coil, it has been known to employ a strapping machine of a type having two adjustably positionable, strap-guiding arms and an adjustably positionable strapping head.

The strap-guiding arms, once positioned at a suitable position for strapping a given coil, are pivotable between a closed position and an opened position. The strapping head, once positioned at a suitable position for strapping a given coil, is operative for feeding the strap along the path defined by the strap-guiding arms at the closed position, tensioning the strap so as to form a tensioned loop around multiple layers of the given coil, severing the tensioned loop from any remaining strap, and applying a steel seal to the tensioned loop.

It would be highly desirable to provide such a machine in which the strap-guiding arms would be automatically positionable so as to enable a given coil within a range of outer diameters to be tightly strapped with one or more straps in a generally radial plane, notwithstanding its nominal, outer diameter.

SUMMARY OF THE INVENTION

This invention provides an improved machine for strapping a sheet metal coil, such as a sheet steel coil, which has an eye defining an axis of the coil.

The improved machine comprises a fixed base, a support arranged to support such a coil with its axis extending transversely, a carriage mounted upon the fixed base and movable longitudinally toward and away from the support, and an elongate cradle mounted upon the carriage and movable with the carriage. The elongate cradle is also pivotable on the carriage about a transverse axis.

The improved machine also comprises two strap-guiding arms mounted upon the cradle and movable with the cradle. The strap-guiding arms are also pivotable on the cradle between a closed position wherein such arms define a path for feeding a strap through the eye of such a coil supported by the support and an opened position wherein such arms can clear the supported coil when the cradle is moved with the carriage.

The improved machine also comprises a coil-sensing arm extending above the strap-guiding arms. The coil-sensing arm is mounted upon the carriage so as to be longitudinally movable with the carriage. The coil-sensing arm is also pivotable on the carriage about a transverse axis.

The improved machine also comprises means coacting with the carriage, with the cradle, and with the coil-sensing arm for pivoting the cradle and the coil-sensing arm simultaneously. Preferably, the pivoting means comprises fluid-powered mechanisms coacting with the carriage, with the cradle, and with the coil-sensing arm. Preferably, a generally upright structure is rigidly mounted upon the cradle, and the pivoting means is connected to the generally upright structure.

In a preferred embodiment, the coil-sensing arm has a main portion extending above the strap-guiding arms and a back portion, the coil-sensing arm is pivotable between a raised position of the main portion and a lowered position of the main portion, and a lever is mounted upon the coil-sensing arm so as to be pivotable about an axis parallel with the axes of pivotal movement of the cradle and the coil-sensing arm. Moreover, the lever coacts with the pivoting means and is biased toward the coil-sensing arm so as to pivot with the coil-sensing arm from the raised position of the main portion of the coil-sensing arm toward the lowered position thereof until such time as the coil-sensing arm engages such a coil supported by the support, at which time the coil-sensing arm can pivot away from the lever.

In the preferred embodiment, the pivoting means is controlled by means of a normally opened switch, which is secured to the coil-sensing arm. The normally opened switch has an actuator extending toward the lever. Furthermore, the lever is biased toward the actuator as well as toward the coil-sensing arm so as to close the switch by engaging the actuator until such time as the coil-sensing arm engages such a coil supported by the support, at which time the lever can pivot away from the actuator as well as away from the coil-sensing arm.

Preferably, a strapping head is mounted upon the cradle so as to be pivotable with the cradle and so as to be movable along the cradle, when the carriage is in the advanced position, toward and away from such a coil supported by the support. Preferably, moreover, the machine further comprises means for sensing when the strapping head has been moved into the vicinity of such a coil supported by the support.

In the strapping machine, the support may comprise a pair of support rolls, whereupon the strapping machine may comprise means for rotating such a coil supported by the support rolls. The coil-sensing arm may have rollers arranged to engage such a coil supported by the support as the supported coil is being rotated.

BRIEF DESCRIPTION OF THE DRAWINGS

These and other objects, features, and advantages of this invention will be evident from the following description of a preferred embodiment of this invention with reference to the accompanying drawings, wherein like reference characters designate like or corresponding parts throughout the several views, and wherein:

FIGS. 6A, 6B, 6C, on a scale similar to the scale of FIGS. 2 and 3, are fragmentary, elevational views showing the strapping machine progressing from a standby condition, through an intermediate condition, to a final condition in connection with the strapping of a relatively large coil.

FIG. 7 is a similar view showing the strapping machine in the final condition after strapping of a relatively small coil.

DETAILED DESCRIPTION OF THE PREFERRED EMBODIMENT

Figure 1:
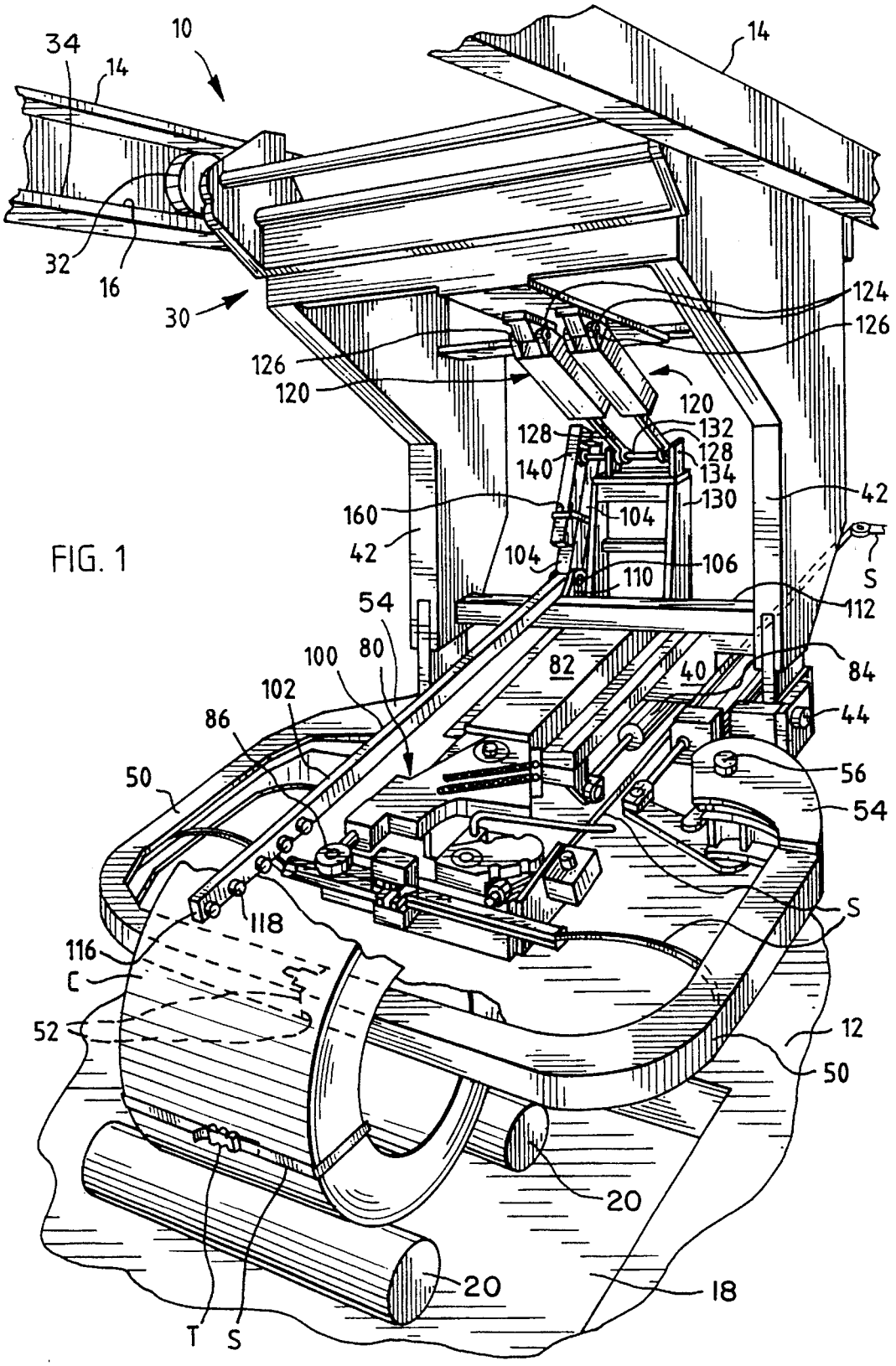
FIG. 1 is a fragmentary, perspective view of a strapping machine embodying this invention, as used to apply a steel or plastic strap around multiple layers of a coil of sheet metal.
Figure 2:
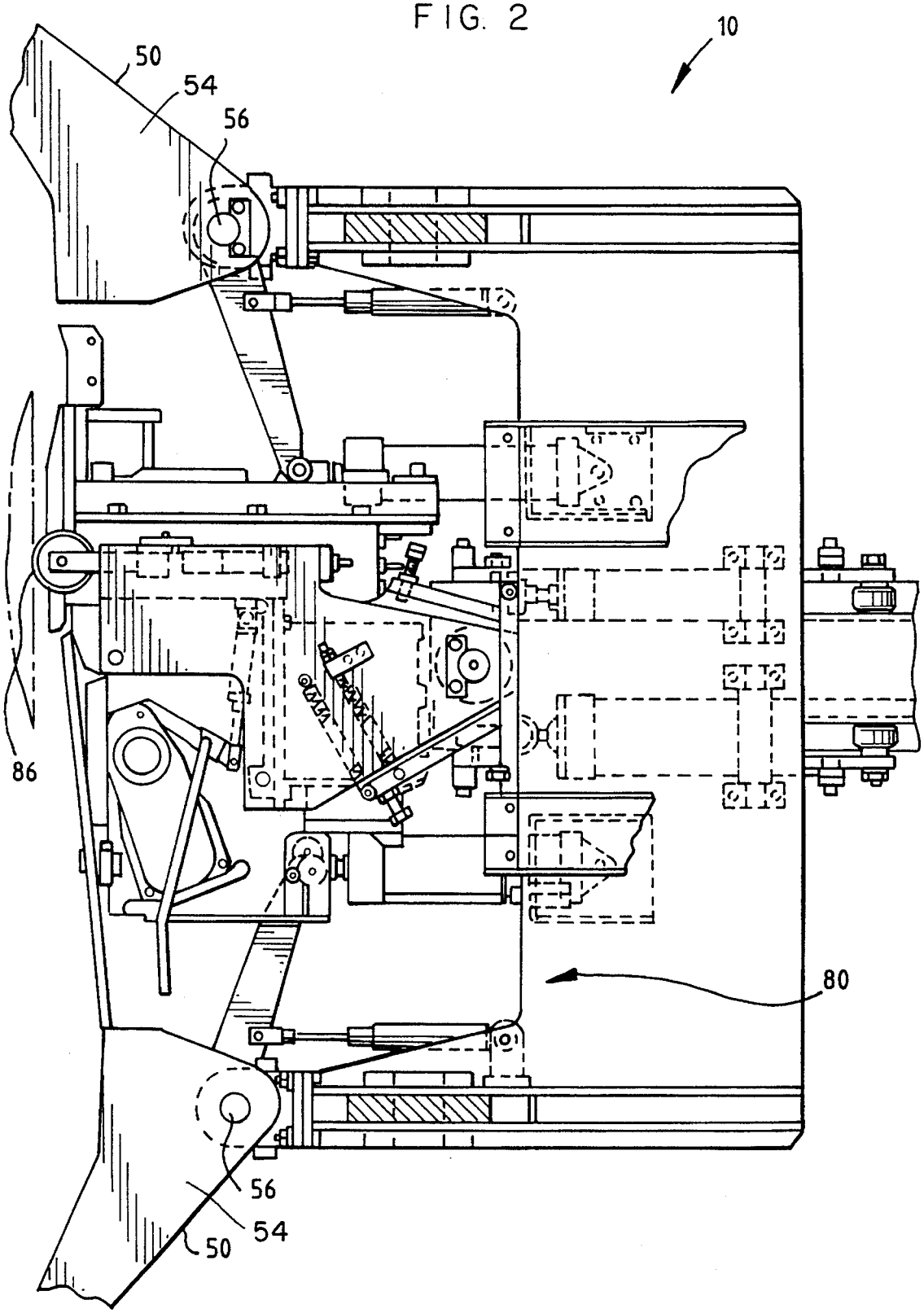
FIG. 2 is an enlarged, fragmentary detail of the strapping machine, as shown in FIG. 1.
Figure 3:
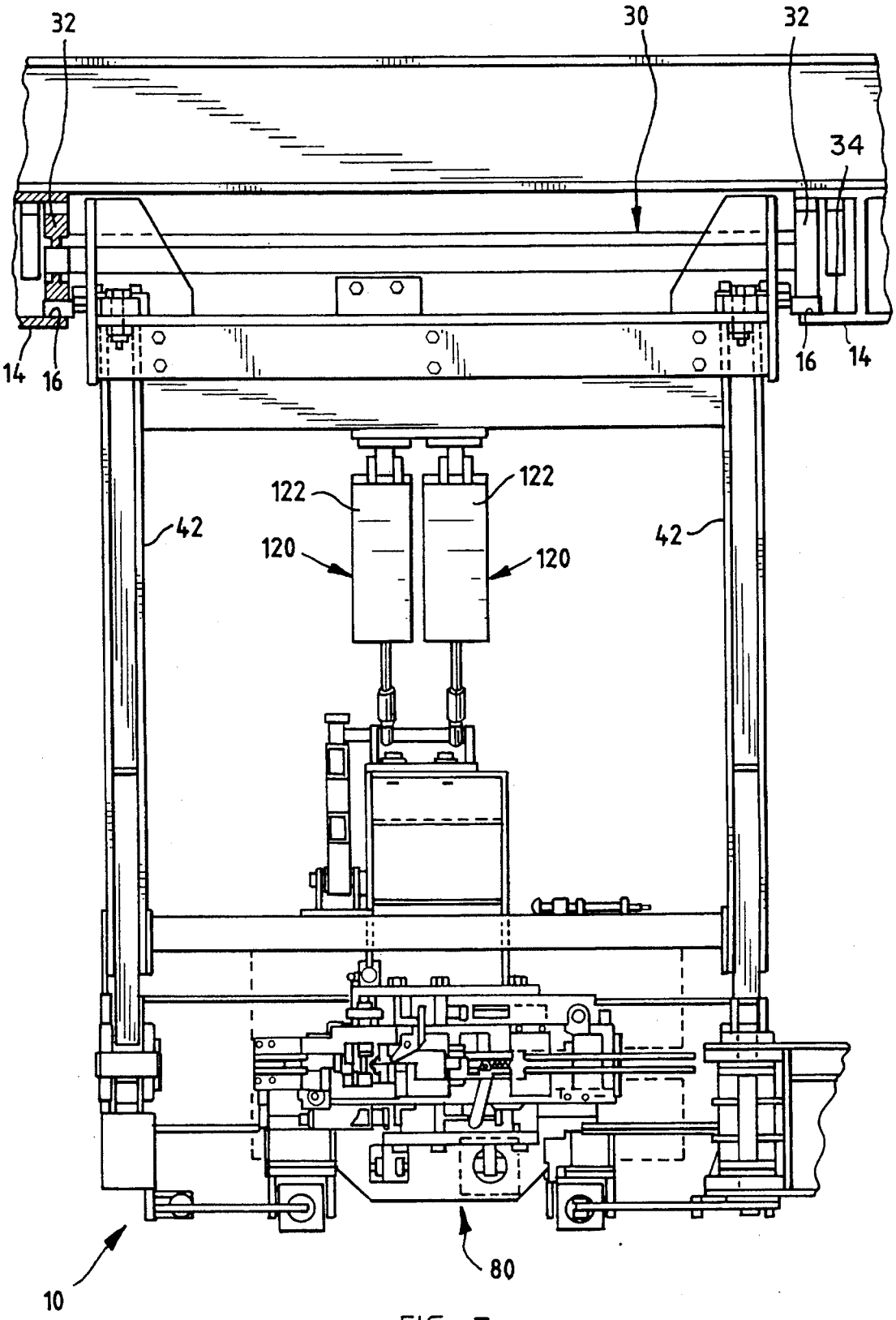
FIG. 3 is a similarly enlarged, fragmentary detail of the strapping machine, as viewed from a front vantage point.

As shown in FIG. 1 and other views, a machine 10 for strapping a sheet metal coil with one or more steel or plastic straps S constitutes a preferred embodiment of this invention. Such a coil has an eye defining an axis of the coil.

Figure 8:
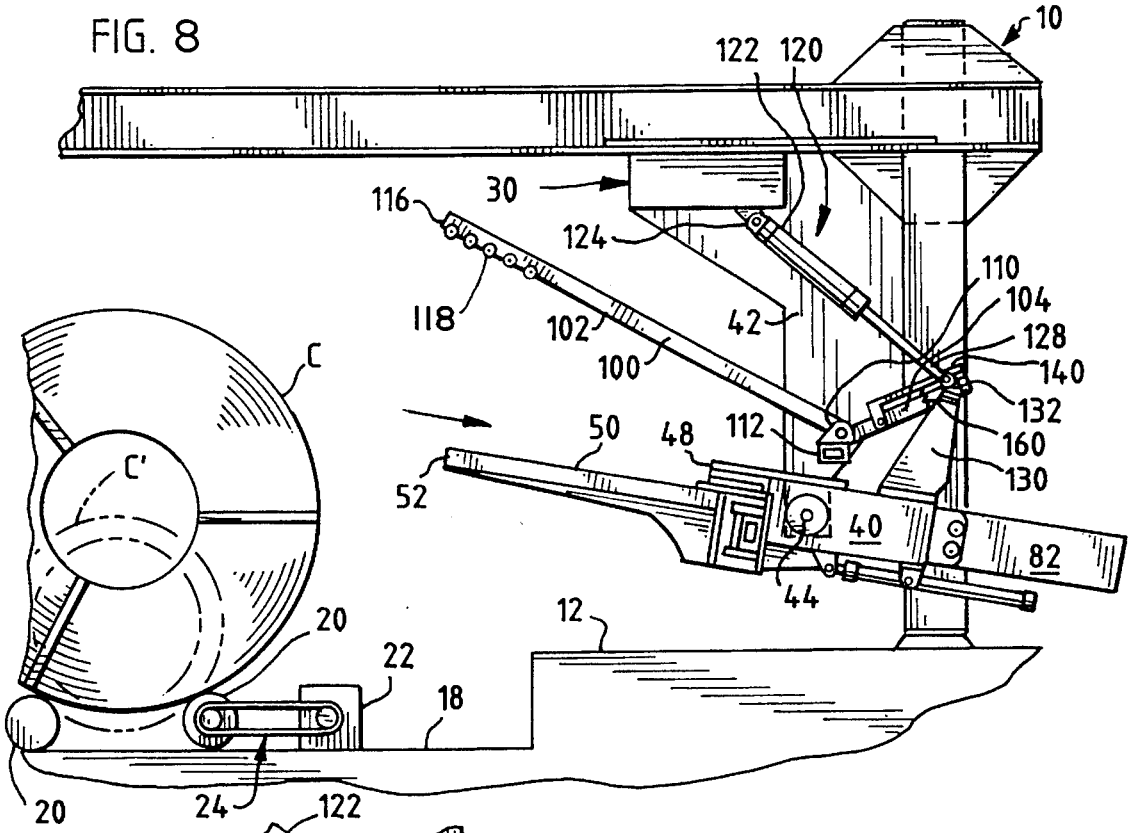
FIG. 8 is a similar view showing the strapping machine returning to the standby condition after three straps have been applied to a relatively large coil.

The coil-strapping machine 10 can accommodate such a coil having any axial width within a range of axial widths. Also, the coil-strapping machine 10 can accommodate such a coil having any nominal, outer diameter within a range of outer diameters, as illustrated in FIG. 1 and other views, in which a sheet metal coil C has a relatively large, nominal outer diameter, and as illustrated in FIG. 7, in which a sheet metal coil C' has a relatively small, nominal, outer diameter. In FIG. 8, the sheet metal coil C is shown in solid lines, and the sheet metal coil C' is shown in dashed lines. The coil-strapping machine 10 enables such a coil to be tightly strapped with one or more steel or plastic straps S in a generally radial plane, notwithstanding its nominal, outer diameter.

The coil-strapping machine 10 comprises a fixed base 12. The fixed base 12 includes two parallel, elevated, horizontal beams 14, each of which defines a track 16. Also, the fixed base 12 includes a lower structure 18 mounting two support rolls 20, which define a support arranged to support a sheet metal coil with its axis extending transversely. Rather than the support rolls 20, a conventional, saddle-shaped support (not shown) may be alternatively employed to define such a support.

As suggested in FIG. 8, a supported coil may be rotatably indexed on the support rolls 20, so as to enable the supported coil to be similarly strapped at suitable (for example 120°) intervals. As shown schematically in FIGS. 6A, 6B, 6C, 7, and 8, the support rolls 20 are rotatably mounted on the lower structure 18 by means of suitable journals (not shown) and one of the support rolls 20 is arranged to be rotatably driven by means of a motor 22 and a belt or chain drive 24.

The coil-strapping machine 10 comprises a carriage 30, which is mounted upon the fixed base 12 so as to be longitudinally movable toward and away from the support rolls 20. The carriage 30 is movable between a retracted position wherein the carriage 30 is shown in FIGS. 6A and 8 and an advanced position wherein the carriage 30 is shown in FIGS. 7A, 7B, and 8.

As shown in FIGS. 1, 3 and 7, 14, each of two front wheels 32 rotatably mounted upon to the carriage 30 is disposed so as to roll on an inner portion 34 of the track 16 defined by each one of the beams 14, and each of two back wheels, not shown, mounted rotatably to the carriage 30 is disposed so as to roll on an outer portion not shown of the track 16 defined by each one of the beams 14. A motor-driven mechanism (not shown) is provided for moving the carriage 30 longitudinally along the tracks 16, toward and away from the support rolls 20, between the retracted and advanced positions noted above.

The coil-strapping machine 10 comprises an elongate, strapping head cradle 40. The cradle 40 is mounted upon two vertical walls 42 of the carriage 30, by means of a pivot pin 44 defining a transverse axis and journalled within the upright walls 42 of the carriage 30 at opposite ends of the pivot pin 44, so as to be longitudinally movable with the carriage 30 toward and away from the support rolls 20 and so as to also be pivotable about the transverse axis defined by the pivot pin 44. The cradle 40 is pivotable over a range of pivotal movement between a position wherein a front end 48 of the cradle 40 is raised to a maximum elevation relative to the lower structure 18, generally as shown in FIGS. 6A and 6B, and a position wherein the front end 48 is lowered to a minimum elevation relative thereto, generally as shown in FIG. 7.

The coil-strapping machine 10 comprises two generally C-shaped, strap-guiding arms 50, each having a distal end 52 and a proximal end 54. These arms 50 are mounted upon the cradle 40 so as to extend forwardly from the cradle 40, so as to be longitudinally movable with the cradle 40 and the carriage 30, toward and away from the support rolls 20, so as to be conjointly pivotable with the cradle 40 about the transverse axis defined by the pivot pins 44, and so as to also be pivotable in a manner to be next described.

Figure 4:
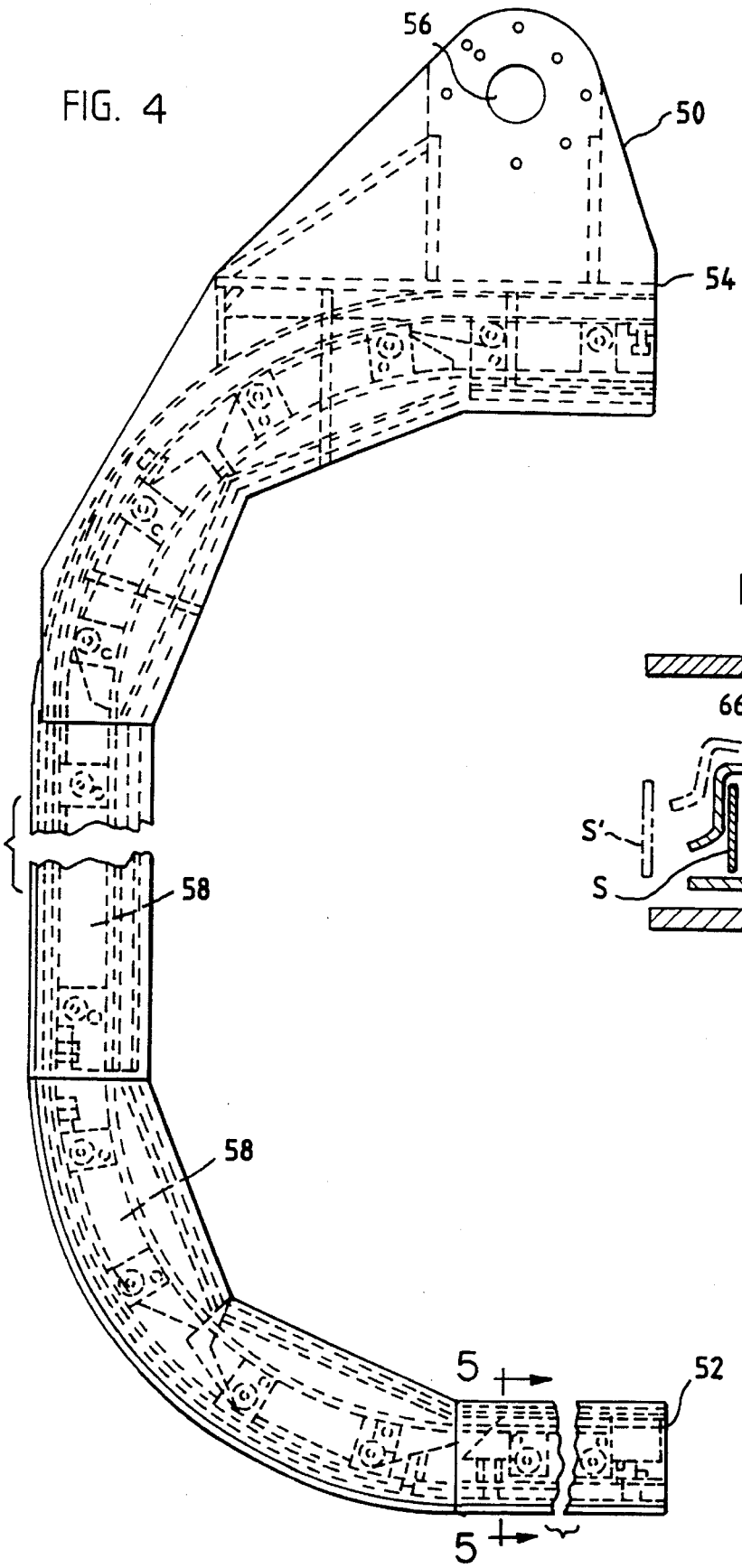
FIG. 4 is a similarly enlarged, fragmentary, plan view of one of two strap-guiding arms of the strapping machine.
Figure 11:
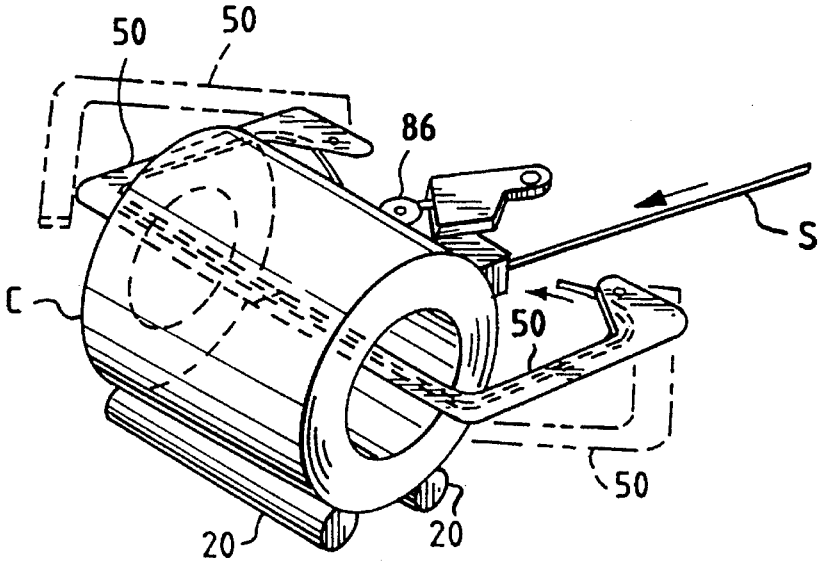
FIGS. 11, 12, and 13 are fragmentary, perspective, schematic views showing successive stages in operation of the strapping machine to apply a strap to a coil.
Figure 12:
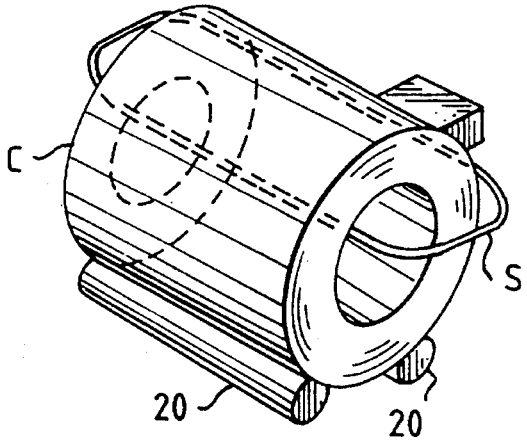
Figure 13:
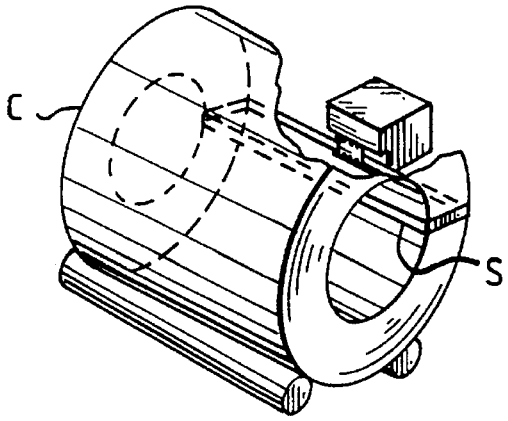
Figure 14:
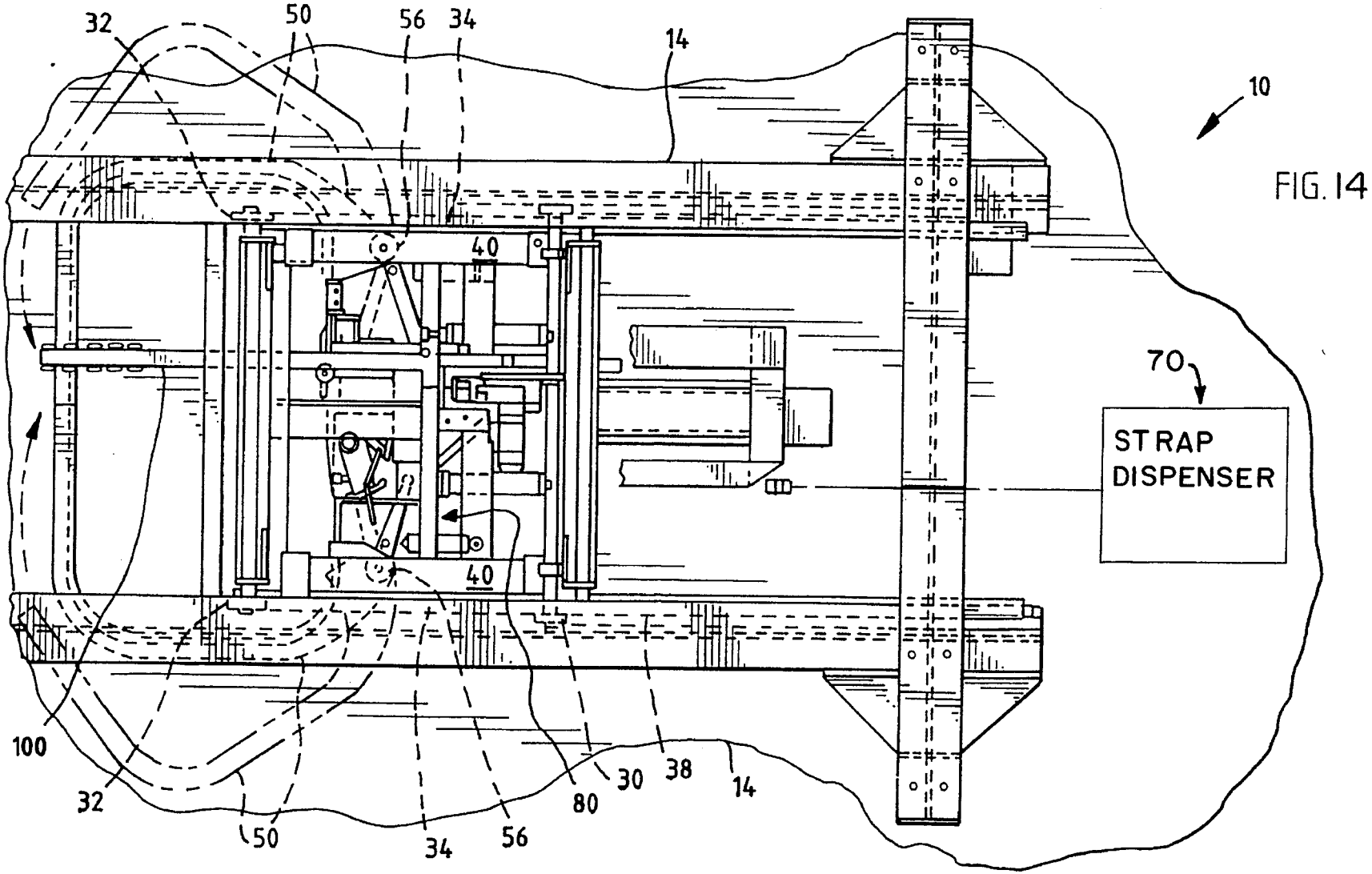
FIG. 14 is a fragmentary, plan view of the strapping machine of the present invention, shown together diagrammatically with an associated strap dispenser for dispensing the steel or plastic strap. strap.

As shown in FIG. 4, in which one strap-guiding arm 50 is shown apart from other elements of the coil-strapping machine 10, each strap-guiding arm 50 is pivotably mounted upon to the cradle 40, by means of a pivot pin 56 near the proximal end 54 of such arm 50. The strap-guiding arms 50 are pivotably mounted upon to the cradle 40 so as to be oppositely pivotable on the cradle 40 between a closed position wherein the distal ends 52 engage each other so as to define a path for feeding a steel or plastic strap through the eye of a sheet metal coil supported by the support rolls 20 and an opened position wherein the distal ends 52 are separated so as to enable the strap-guiding arms 50 to clear such a supported coil when the cradle 40 is moved with the carriage 30. In FIGS. 11 and 14, these arms 50 are shown in the closed position in solid lines and in the opened condition in dashed lines.

Figure 5:
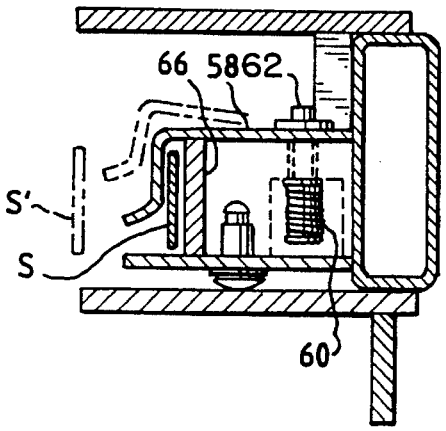
FIG. 5 is a further enlarged, sectional view taken along line 5—5 of FIG. 4, in a direction indicated by arrows.

As shown in FIGS. 4 and 5, each strap-guiding arm 50 is similar to strap-guiding arms known heretofore and includes a series of strap gates 58, each of which is biased by coiled springs 60 coacting with gate-retaining pins 62 extending through a base portion of such strap-guiding arm 50 to a strap-guiding position but is displaceable to a strap-releasing position. In the strap-guiding position, each strap gate 58 coacts with a wall portion 66 of the strap-guiding arm 50 including such strap gate 58, so as to confine a strap being fed. In the strap-releasing position, each strap gate 58 is displaced when a strap having been fed is tensioned in a manner to be later discussed, so as to release the strap. In FIG. 5, one such gate 58 is shown in the strap-guiding position in solid lines and in the strap-releasing position in dashed lines, and a strap S being fed is shown in solid lines and a strap S' having been released is shown in dashed lines.

The coil-strapping machine 10 comprises a strap dispenser 70 and a strapping head 80. As shown in FIG. 14, the strap dispenser 70 may be substantially similar to strap dispensers known heretofore and is employed to dispense a steel or plastic strap of indeterminate length to the strapping head 80 in a known manner. Details of the strap dispenser 70 are outside the scope of this invention. Except as illustrated and described herein, the strapping head 80 may be substantially similar to strapping heads known heretofore, and details of the strapping head 80 are also outside the scope of this invention.

As illustrated in FIG. 1, once the strapping head 80 has been positioned in a manner to be later described against a sheet metal coil C supported by the support rolls 20, the strapping head 80 is operable in a known manner for feeding a steel or plastic strap S through the eye of the supported coil C, tensioning the strap S to form a tensioned loop around multiple layers of the supported coil C, severing the tensioned loop from any remaining strap S, and sealing the tensioned loop by applying a steel seal T.

The strapping head 80 is mounted upon the cradle 40, by means of machine slides 82 shown generally in FIG. 1, so as to be pivotable with the cradle 40 on the transverse axis defined by the pivot pins 44 and so as to be movable along the cradle 40, toward and away from a sheet metal coil supported by the support rolls 20, between a retracted position and an advanced position. As shown in FIG. 1, a pneumatically powered, hydraulically paced, double-acting, piston-cylinder mechanism 84, mounted upon the cradle 40, coacts with the strapping head 80 for advancing the strapping head 80 toward the supported coil and for retracting the strapping head 80 away from the supported coil. The piston-cylinder mechanism 84 is controlled by a sensing roller 86, which is operatively mounted on the strapping head 80, which is arranged to engage the supported coil so as to sense when the strapping head 80 has been advanced into the vicinity of the supported coil, and which is arranged to deactuate such mechanism 84 so as to arrest the advancing movement of the strapping head 80 when the sensing roller 86 has engaged the supported coil.

The strapping machine 10 comprises a coil-sensing arm 100, which has a main portion 102 extending above the strap-guiding arms 50, and which has a rear portion 104 defining an obtuse angle relative to the main portion 102 when such arm 100 is viewed from either side. The coil-sensing arm 100 is mounted upon the vertical walls 42 of the carriage 30, by means of a pivot pin 106 defining a transverse axis of pivotal movement of such arm 100 and extending through an aperture (not shown) in the main portion 102, near the rear portion 104, so as to be longitudinally movable with the carriage 30. The pivot pin 106 enables the coil-sensing arm 100 to also be pivotable on the carriage 30, about the transverse axis defined by the pivot pin 106, between a position wherein a distal end 116 of the main portion 102 is raised to a maximum elevation relative to the lower structure 18 and a position wherein the distal end 116 is lowered to a minimum elevation relative thereto. The pivot pin 106 coacts with a generally U-shaped bracket 110, which is seated on a beam 112 extending transversely between the vertical walls 42 of the carriage 30. Near the distal end 116, the main portion 102 of the coil-sensing arm 100 has a series of spaced pairs of small rollers 118, one roller 118 of each pair being disposed on each side of such main portion 102.

A set of fluid-powered, double-acting, piston-cylinder mechanisms 120 are provided, namely a pneumatically powered, piston-cylinder mechanism and a hydraulically powered piston-cylinder mechanism, which coact in a known manner so that the hydraulically powered mechanism paces the pneumatically powered mechanism. Each piston-cylinder mechanism 120 comprises a cylinder 122 pivotably mounted upon the carriage 30 by means of a pivot pin 124 defining a transverse axis and coacting with a bracket 126 secured to the carriage 30, a piston operative within the cylinder 122, and a piston rod 128 connected to the piston and extending from the cylinder 122. A generally upright structure 130 is rigidly mounted upon the cradle 40 behind the pivot pin 44. The piston rods 128 are pivotably connected to the structure 130 by means of a pivot pin 132 coacting with a bracket 134 secured to the structure 130. Thus, when the piston-cylinder mechanisms 120 are actuated so as to extend the piston rods 128 from the cylinders 122, the coil-sensing arm 100 is pivoted so that the distal end 116 of its main portion 102 is moved upwardly. Also, when the piston-cylinder mechanisms 120 are actuated so as to retract the piston rods 128 into the cylinders 122, the coil-sensing arm 100 is pivoted so that the distal end 116 of its main portion 102 is moved downwardly.

Figure 9:
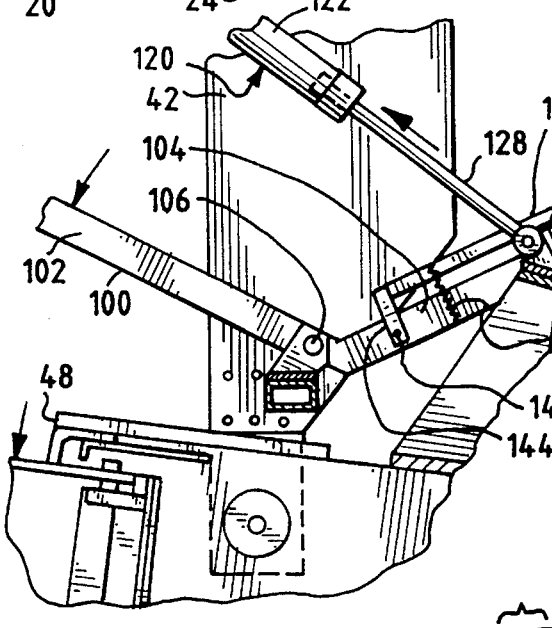
FIGS. 9 and 10, on a slightly larger scale, are fragmentary, elevational details showing a normally opened switch, respectively as closed by a lever coacting with a coil-sensing arm before the coil-sensing arm engages a coil and as permitted to open and opened after the coil-sensing arm has engaged the coil.
Figure 10:
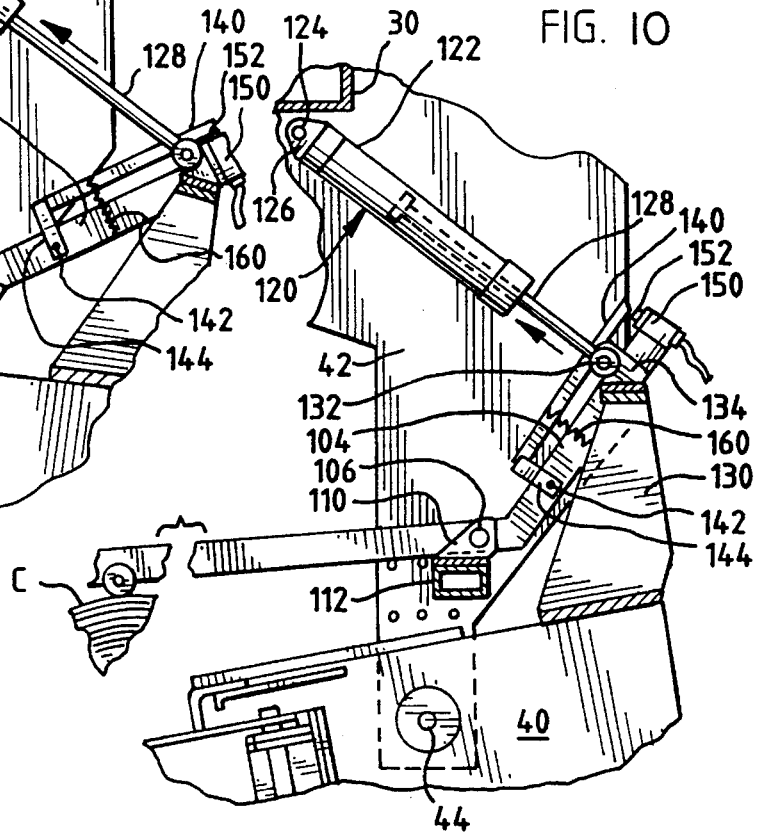

A lever 140 is pivotally mounted portion 104 of the coil-sensing arm 100, by means of a pivot pin 142 defining an axis of pivotal movement of the lever 140 and coacting with such portion 104 and with a proximal portion 144 of the lever 140, so as to be pivotable about such axis, all is best seen in FIGS. 9 and 10. Such axis is parallel with the axes of pivotal movement of the cradle 40 and the coil-sensing arm 100. A normally opened switch 150, which is secured to the rear portion 104 of the coil-sensing arm 100, has an actuator 152 extending toward the lever 140.

A coiled spring 160 is wrapped around the rear portion 104 of the coil-sensing arm 100 and around the rear lever 140 so as to bias the lever 140 towards such portion 104, so as to cause the lever 140 to pivot with the coil-sensing arm 100 from the raised position of the main portion 102 toward the lowered position of the main portion 102, and so as to cause the lever 140 to close the switch 150 by engaging the actuator 152 until such time as the main portion 102 engages such a coil supported by the support rolls 20, at which time the rear portion 104 of the coil-sensing arm 100 is permitted by the coiled spring 160 to pivot and pivots away from the lever 140 so as to allow the switch 150 to open.

The pivot pin 106, on which the coil-sensing arm 100 is pivotable, is positioned in relation to the pivot pin 44, on which the cradle 40 is pivotable, so that the cradle 40 is pivoted less rapidly and the coil-sensing arm 100 is pivoted simultaneously but more rapidly when the piston-cylinder mechanisms 120 are actuated. After the carriage 30 has been moved into the advanced position, such mechanisms 120 are actuated so as to move the distal end 116 of the main portion 102 of the coil-sensing arm 100 downwardly until the main portion 102 thereof engages a sheet metal coil supported by the support rolls 20, whereby the strap-guiding arms 50 are pivoted simultaneously until the distal ends 52 of such arms 50 reach a position wherein the coil axis extends through such ends 52.

A programmable controller (not shown) coacting with the sensing roller 86, the normally opened switch 150, and other controls (not shown) is provided for controlling the motors and piston-cylinder mechanisms noted above and for controlling the strapping head 80.

In a standby condition of the strapping machine 10, the strap-guiding arms 50 have been pivoted to the opened position described above wherein the distal ends 52 of such arms 50 are separated, as shown in dashed lines in FIG. 11 and 14. Further, the cradle 140 has been pivoted to the position described above wherein its front end 48 has been raised to its maximum elevation relative to the lower structure 18, as shown in FIG. 6A. Moreover, the coil-sensing arm 100 has been pivoted to the position noted above wherein the distal end 116 of the main portion 102 of such arm 100 has been raised to its maximum elevation relative to the lower structure, as shown in FIG. 6A. Furthermore, the strapping head 80 has been retracted to its retracted position, as shown in FIG. 6A.

Initially, when the strapping machine 10 is operated to strap a sheet metal coil supported by the support rolls 20, the carriage 30 is advanced along the tracks 16 until the carriage 30 reaches the advanced position noted above. Automatically, therefore, the distal ends 52 of the strap-guiding arms 50 are positioned approximately at a vertical plane comprising the axis defined by the eye of the supported coil. Because the supported coil is centered on the support rolls 20, it does not matter whether the nominal, outer diameter of such coil is large or small.

Next, the piston-cylinder mechanisms 120 are actuated so as to pivot the cradle 40 and the strap-guiding arms 50 conjointly and the coil-sensing arm 100 simultaneously in such manner that the front end 48 of the cradle 40 and the distal ends 52 of the strap-guiding arms 50 are moved downwardly and that the distal end 116 of the main portion 102 of the coil-sensing arm 100 is moved downwardly, until the switch 150 is deactuated when any of the small rollers 118 on the main portion 102 of the coil-sensing arm 100 engages the supported coil and the rear portion 104 of the coil-sensing arm 100 is pivoted away from the lever 140. Because of the geometry of the strapping machine 10, the cradle 40 and the strap-guiding arms 50 are pivoted less rapidly, and the coil-sensing arm 100 is pivoted more rapidly. Automatically, therefore, the distal ends 52 of the strap-guiding arms 50 are pivoted to positions wherein a part of the strap-guiding path defined by such arms 50 when pivoted to the closed position passes generally along the axis defined by the eye of the supported coil.

Next, the strap-guiding arms 50 are pivoted to the closed position noted above. Thereupon, the strapping head 80 is operated in a known manner to feed a strap from the strap dispenser 70 along the path defined by the strap-guiding arms 50 in the closed position noted above. After the strap end is gripped by the strapping head 80, the piston-cylinder mechanism 84 is actuated so as to advance the strapping head 80 toward the supported coil until the sensing roller 86 engages the supported coil.

When the sensing roller 86 engages the supported coil, the piston-cylinder mechanism 84 is deactuated, whereby the advancing movement of the strapping head 80 is arrested. Thereupon, the strapping head 80 is operated to take up the strap so as to form a tensioned loop around multiple layers of the supported coil, to sever the tensioned loop from any remaining strap from the strap dispenser 70, and to apply a steel seal to the tensioned loop. Automatically, as shown in FIG. 8, the strap is applied approximately in a radial plane.

After one strap has been applied, the supported coil can then be rotated on the support rolls 20, via the motor 22 and the belt or chain drive 24, to positions where additional straps can be similarly applied, as shown in FIG. 8. As such coil is rotated on the support rolls 20, the small rollers 118 on the main portion 102 of the coil-sensing arm 100 roll on the supported coil so as to avoid scratching the outer layer of such coil.

Finally, after the straps have been applied to the supported coil, the strapping machine 10 is returned to the standby condition described above.

A preferred geometry for the preferred embodiment described above will be described next. With the preferred geometry, the strapping machine 10 can accommodate a sheet metal coil having a minimum, nominal, outer radius (hereinafter "RC MIN") equal to 39 inches and a maximum, nominal, outer radius (hereinafter "RC MAX") equal to 77 inches.

In the preferred geometry, all measurements are taken with the carriage 30 in the advanced position noted above. Moreover, some measurements are taken from a transverse, datum line, which is marked "(0,0)" in FIG. 6A.

The transverse axis defined by the pivot pin 44 mounting the cradle 40 is displaced backwardly by a distance (hereinafter distance "X1") equal to 70 inches from a vertical plane comprising the transverse, datum line and upwardly by a distance (hereinafter distance "Y1") equal to 25.187 inches above a horizontal plane comprising the transverse, datum line.

The transverse axis defined by the pivot pin 106 mounting the coil-sensing arm 100 is displaced backwardly by a distance (hereinafter distance "X2") equal to 75.906 inches from the vertical plane comprising the transverse, datum line and upwardly by a distance (hereinafter distance "Y2") equal to of 41.718 inches above the horizontal plane comprising the transverse, datum line.

The obtuse angle defined by the main and rear portions of the coil-sensing arm 100 (hereinafter angle "A") is 129°. A plane comprising the transverse axis defined by the pivot pin 124 and comprising the transverse axis defined by the pivot pin 44 and a plane comprising the transverse axis defined by the pivot pin 44 and the centers of the distal ends 52 of the strap-guiding arms 50 define an obtuse angle (hereinafter angle "B") which is 127.4°.

A thickness measured between a plane extending along the main portion 102 of the coil-sensing arm 100, from the transverse axis defined by the pivot pin 106, so as to bisect the main portion 102 thereof and a plane extending along the main portion 102 thereof where the main portion 102 thereof engages a sheet metal coil supported by the support rolls 20 (hereinafter thickness "TH") is 1.5 inches.

As measured from the transverse axis defined by the pivot pin 44 mounting the cradle 40, the distance to the centers of the distal ends 52 of the strap-guiding arms 50 (hereinafter distance "RA") is 71.85 inches, the distance to the transverse axis defined by the pivot pin 132 connecting the piston-cylinder mechanisms 120 to the bracket 134 on the cradle 40 (hereinafter distance "RI") is 39.968 inches, and the distance to the front face of the strapping head 80 (hereinafter distance "RH") is 22.15 inches.

The radius of each support roll 20 is 4.92 inches. Each support roll 20 defines a central axis displaced longitudinally by a distance (hereinafter distance "A1") equal to 17 inches from the vertical plane comprising the transverse, datum line, one support roll being displaced longitudinally ahead of that plane and the other roll 20 being displaced longitudinally behind that plane. Also, the central axis of each support roll 20 is displaced downwardly by a distance (hereinafter distance "B1") equal to 13.218 inches below the horizontal plane comprising the transverse, datum line.

When the piston rods 128 of the piston-cylinder mechanisms 120 are extended as fully as possible from the cylinders 122, the distance between the pivot pin 124 coacting with the bracket 126 secured to the carriage 30 and the pivot pin 132 coacting with the bracket 134 secured to the structure 130 rigidly mounted upon to the cradle 40 (hereinafter distance "LC MIN") is equal to 30 inches. When the piston rods 128 are retracted as fully as possible into the cylinders 122, the same distance (hereinafter "LC MIN") is equal to 32 inches.

A BASIC program with routines for modifying the preferred geometry of the strapping machine 10 to accommodate a new range of coil radii, for determining the optimum position (X2, Y2) of the pivot pin 106 in relation to the pivot pin 44, and for determining the optimum angle (A) defined by the rear portion 104 of the coil-sensing arm 100 in relation to the main portion 102 thereof for any given position (X2, Y2) thereof is attached as Appendix A.

Various modifications may be made in the preferred embodiment described above without departing from the scope and spirit of this invention. It is therefore to be understood that within the scope of the appended claims, the present invention may be practiced otherwise than as specifically described herein.

Appendix A

The routine "EH3CONFIG" below is for calculating the following values for sheet metal coils within a new range of nominal, outer radii, for new positions of the support rolls 20, or for a new radius of each support roll 20:

(a) The value "M. AN" is the angle formed between a horizontal plane comprising the transverse axis (X1, Y1) defined by the pivot pin 44 and a plane comprising that axis (X1, Y1) and the coil axis (AX, BY) of a sheet metal coil supported by the support rolls 20. See FIG. 6A.

(b) The value "C. CEN." is the vertical distance from the transverse, datum line (0, 0) to the coil axis (AX, BY) where AX=0. See FIG. 6A.

(c) The value "E–CEN." is the distance between the distal ends 52 of the strap guiding arms 50 and the coil axis (AX, BY). See FIG. 6A.

(d) The value "CYL. L." is the distance between the pivot pin 124 and the pivot pin 132. See FIG. 6A.

(e) The value "HD. TRAV." is the distance ("HT") that the strapping head 80 travels between its retracted position and its arrested position located in the vicinity of the supported coil. See FIG. 6B.

The routine "EH3XYARM" below is for determining the optimum position (X2, Y2) of the pivot pin 106 for the coil-sensing arm 100. See FIG. 6A.

The routine "EH3ANGLE" below is for determining the optimum angle (A) defined by the rear portion 104 of the coil-sensing arm 100 in relation to the main portion 102 thereof for any given position (X2, Y2) of the pivot pin 106. See FIG. 6A.

EH3 CONFIG

```
5     REM EH3CONFIG
10    PI=3.14159
20    PRINT:PRINT
22    PRINT "DO YOU TEST ORIGINAL CONFIGURA-
TION OR MODIFIED?"
23    PRINT "ENTER -ORIG- OR -MOD-":INPUT S$
24    IF S$="ORIG" GOTO 34
25    PRINT "INPUT X & Y OF SENSING ARM PIVOT"
26    PRINT "X2=";:INPUT X2
27    PRINT "Y2=";:INPUT Y2
28    PRINT "IMPUT SENSING ARM ANGLE"
29    PRINT"A=";:INPUT A:A=A*PI/180
30    GOTO 40
34    X2=75.906:Y2=41.718
35    A=129*PI/180
40    TH=1.5
41    RA=71.85
42    R1=36.968
43    B=127.4*P1/180
44    X1=70   :Y1=25.187
45    RH=22.15
90    PRINT "INPUT COIL DIA. MIN.";INPUT RCMIN
95    RCMIN=RCMIN/2
100   PRINT "INPUT COIL DIA. MAX.":INPUT RCMAX
105   RCMAX=RCMAX/2
185   PRINT "INPUT A1&B1 (INDEXING ROLLER
CENTER)"
186   PRINT"INPUT A1=";:IMPUT A1:PRINT"INPUT
B1=";:INPUT B1
187   A1=–17:B1=–13.228
190   PRINT "INPUT R0 (RADII OF INDEXING
COIL)";:INPUT R0
195   R0=4.92
200   PRINT:PRINT
210   X9=60.031:Y9=79.5
545   PRINT "C.DIA.","M.AN.","C.CEN.","E-
C.CEN.","CYL.L.";"
HD.TRAV."
546   PRINT
550   FOR RX=RCMIN TO (RCMAX+3) STEP 1
560   BY=SQR((RO+RX)^2–(A1)^2)+B1
600   I=I+1
620   L=(Y2–BY)^2+(X2–AX)^2
630   K=L–(TH+RX)^2
640   A8=(RX+TH)/SQR(L)
660   A8=ATN(A8/(SQR(1–A8^2)))
680   A9=ATN((BY=Y2)/(X2–AX))
700   A10=A9+A8
720   A5=PI–A10–A
730   A10=A5+A
740   XT=X2+SQR(K)*COS(A10):;YT=Y2=+
SQR(K)*SIN(A10)
760   GOTO 1000
780   AX1=X1+RA*COS(BO+B):BY1=Y1+RA*SIN(BO+B)
800   B11=ATN((BY–YI)/(X1–AX)):B12=
ATN((BY1–Y1)/X1–AX1))
840   DDB=2*RA*SIN((B11–B12)/2)
850   HT=SQR((X1–AX)^2+(Y1–BY)^2)–RX–RH
870   PRINT
2*RX,(INT(100*B12*180/PI))/100,(INT(BY*100))/100,ABS
((INT(DDB*100))/100),(INT(SQR((X9–XM)^2+(Y9–
YM)^2)*100))/100;"   ";(INT(HT*100))/100
880   NEXT RX
881   PRINT
882   PRINT "X1,Y1",X1,Y1
883   PRINT "X2,Y2",X2,Y2
884   PRINT "RCMIN, RCMAX",RCMIN,RCMAX
885   PRINT"A1,B1,RO",A1,B1,RO
886   PRINT "R1",R1
887   PRINT "TH",TH
888   PRINT "RA",RA
889   PRINT "B",B*180/P1
890   PRINT "A",A*180/PI
902   PRINT "X9,Y9",X9,Y9
903   PRINT "RH",RH
910   END
1000  M=TAN(A5)
```

-continued

EH3 CONFIG

```
1010  XP=(X1/M+Y1+M*X2−Y2)/(M+1/M)
1020  YP=M*XP−M*X2+Y2
1030  DXP=(X1−XP)^2+(Y1−YP)^2
1040  Z=SQR(R1^2−DXP)
1050  XM=XP+Z*COS(AS):YM=YP+Z*SIN(A5)
1060  B0=ATN((YM−Y1)/(XM−X1))
1070  GOTO 780
```

EH3XYARM

```
1     REM EH3XYARM
2     TH=1.5
5     PI=3.14159
7     PRINT "INPUT A1&B1 (CENTER OF INDEXING
COIL)"
8     PRINT "INPUT A1=":INPUT A1:PRINT"INPUT
B1=";INPUT B1
9     PRINT "INPUT RADII OF INDEXING COIL":PRINT
"INPUT R0=":INPUT R0
13    PRINT "INPUT COIL DIA.MAX":INPUT RCMAX
14    PRINT "INPUT COIL DIA. MIN.":INPUT RCMIN
18    RMIN=RCMIN/2:RMAX=RCMAX/2
20    X1=70:Y1=25.187
35    R1=36.968
37    B=127.4*PI/180
185   W0=1003:T0=1003
190   FOR X2=71 TO 81 STEP .5
195   FOR Y2=41 TO 46 STEP .5
197   AMIN=1000:AMAX=0
200   FOR RX=RMIN TO RMAX STEP (RMAX−RMIN)/5
250   AX=0:BY=SQR((R0+RX)^2(A1)^2)+B1
280   B11=ATN((BY=Y1)/(X1−AX))
300   BO=PI−B−B11
320   XM=X1+R1*COS(B0):YM=Y1+R1*SIN(B0)
340   A9=ATN((BY−Y2)/(X2−AX))
360   L=(X2−AX)^2+(Y2−BY)^2
370   K=L−(RX+TH)^2
380   AB=(RX+TH)/SOQ(L)
390   A8=ATN(A8/(SQR(1−A8^2)))
400   A10=A8+49
405   A5=ATN((YM−Y2)/(XM−X2))
410   A=PI=A10−A5
412   IF A<AMIN THEN AMIN=A
414   IF A>AMAX THEN AMAX=A
420   A10=AT+A
470   NEXT RX
472   W=AMAX−AMIN
475   IF W<W0 THEN W0=W:X10=X2:Y10=Y2
480   NEXT Y2
500   NEXT X2
505   PRINT:PRINT
507   PRINT "OPTIMUM LOCATION"
510   PRINT "X2=";X10,"Y2=";Y10
520   PRINT
530   PRINT "ORIGINAL EH3 X2=75.906 Y2=41.718"
```

EH3ANGLE

```
1     REM EH3ANGLE
2     TH=1.5
5     PI=3.14159
6     W0=1003
7     AMIN=1000:AMAX=0
14    XI=70:Y1=25.187
30    RA=71.85
35    R1=36.968
37    B=127.28*PI/180
40    PRINT "INPUT A1&B1(CENTER OF INDEXING
ROLLER)"
41    PRINT "INPUT A1=";:INPUT A1
42    PRINT "INPUT B1=";:INPUT B1
43    PRINT "INPUT RADII OF INDEXING ROLLER R0:
44    PRINT "R0=";:INPUT R0
```

-continued

EH3ANGLE

```
45    A1=17:B1=−13.228
90    PRINT "INPUT COIL DIA. MIN.":INPUT RCMIN
95    RCMIN=RCMIN/2
100   PRINT "INPUT COIL DIA. MAX.":INPUT RCMAX
105   RCMAX =RCMAX/2
170   PRINT "INPUT X & Y OF SENSING ARM PIVOT"
175   PRINT "X=";:INPUT X2
180   PRINT "Y=";:INPUT Y2
185   PRINT "INPUT DELTA COIL CENTER - END OF
ARM";:INPU DB11
190   DB11=ATN(DB11/RA)
200   FOR RX=RCMIN TO RCMAX STEP
(RCMAX −RCMIN)/10
210   I=I+1
250   AX=0:BY=SQR((R0+RX)^2−(A1)^2)+B1
280   B11=ATN((BY−Y1)/(X1−AX))
290   B11=B11+DB11
300   B0=PI−B−B11
320   XM=X1+R1*COS(B0):YM=Y1+R1*SIN(B0)
340   A9=ATN((BY−Y2)/(X2−AX))
360   L−(X2−AX)^2+(Y2−BY)^2
380   A8=RX+TH)/SQR(L)
390   A8=ATN(A8/(SQR(1−A8^2)))
400   A10=A8+A9
405   A5=ATN((YM−Y2)/(XM−X2)
408   A=PI−A10−A5
409   SA=SA+A
412   IF A<AMIN THEN AMIN=A
414   IF A>AMAX THEN AMAX=A
470   NEXT RX
472   W=AMAX−AMIN
475   IF W<W0 THEN GOTO 500
477   GOTO 530
500   WO=W
530   A=SA/I
540   PRINT
550   PRINT"SENSING ARM ANGLE A=";A*180/PI
```

We claim:

1. A machine for strapping a sheet metal coil, which has an eye defining an axis of said coil, comprising:

a fixed base;

support means for supporting said coil with said axis extending transversely;

a carriage movably mounted upon said fixed base so as to be movable longitudinally toward and away from said support means and said coil supported upon said support means;

a cradle pivotably mounted upon said carriage about a transverse axis so as to be pivotable toward and away from said coil;

a pair of strap-guiding arms pivotably mounted upon said cradle between a closed position wherein said strap-guiding arms define a path for feeding a strap through said eye of said coil supported upon said support means, and an open position wherein said strap-guiding arms are remote from said coil supported upon said support means so as to permit a coil to be mounted upon or removed from said support means;

a coil-sensing arm mounted upon said carriage for engagement with said coil when said cradle is pivotably moved toward said coil; and means for pivoting said strap-guiding arms, when said coil-sensing arm engages said coil supported upon said support means such that said strap-guiding arms are moved to said closed position so as to define said path which extends along said axis defined by said eye of said coil supported upon said support means.

2. The machine of claim 1, further comprising:

a substantially upright structure rigidly mounted upon said cradle; and said pivoting means is connected to said substantially upright structure.

3. The machine of claim 2, wherein:

said coil-sensing arm comprises a main portion extending above said strap-guiding arms, and a rear portion;

said coil-sensing arm is pivotably mounted upon said carriage such that said main portion of said coil-sensing arm is movable between a raised position portion and a lowered position; and a lever is mounted upon said rear portion of said coil-sensing arm so as to be pivotable about an axis disposed parallel to said transverse axis of said cradle and a transverse axis of said coil-sensing arm, said lever coacting with said pivoting means and being biased toward said rear portion of said coil-sensing arm so as to pivot with said main portion of said coil-sensing arm from said raised position of said main portion of said coil-sensing arm toward said lowered position of said main portion of said coil-sensing arm until such time that said main portion of said coil-sensing arm engages said coil supported upon said support means, at which time said rear portion of said coil-sensing arm can pivot away from said lever.

4. The machine of claim 3, wherein a normally open switch is secured to said rear portion of said coil-sensing arm for controlling said pivoting means, and includes an actuator extending toward said lever; and said lever is biased toward said actuator and said rear portion of said coil-sensing arm so as to close said switch by engaging said actuator until such time that said main portion of said coil-sensing arm engages said coil supported upon said support means, at which time said lever can pivot away from said rear portion of said coil-sensing arm and said actuator so as to permit said switch to open.

5. The machine of claim 1, further comprising:

a strapping head mounted upon said cradle so as to be pivotable with said cradle and movable along said cradle toward and away from said coil supported upon said support means.

6. The machine of claim 5, further comprising:

means for sensing when said strapping head has been moved into engagement with said coil supported upon said support means.

7. The machine as set forth in claim 6, further, comprising:

piston-cylinder means for moving said strapping head along said cradle; and said sensing means comprises a sensing roller mounted upon said strapping head for engaging said supported coil and thereby deactuating said piston-cylinder means for said strapping head.

8. The machine of claim 1, further comprising:

fluid-powered mechanisms for simultaneously pivoting said cradle and said coil-sensing arm such that said coil-sensing arm is pivoted more rapidly idly than said cradle.

9. The strapping machine of claim 1 wherein the support means comprises a pair of support rolls.

10. The strapping machine of claim 9, further comprising:

means for rotating said support rolls so as to in turn rotate said coil supported upon said support rolls.

11. The strapping machine of claim 10, wherein:

said coil-sensing arm has rollers for engaging said coil supported upon said support rolls as said supported coil is being rotated.

12. The machine as set forth in claim 10, wherein:

said means for rotating said support rolls comprises a belt drive system operatively connected to one of said support rolls.

13. The machine as set forth in claim 1, wherein:

said sheet metal coil comprises a sheet steel coil.

* * * * *